United States Patent [19]

Appledorn et al.

[11] Patent Number: 4,800,815

[45] Date of Patent: Jan. 31, 1989

[54] SHAPED CHARGE CARRIER

[75] Inventors: Roger C. Appledorn, Katy; Lary G. Ratliff, Columbus, both of Tex.; William C. Behling, Duncan, Okla.; Michael L. Oestreich, Katy, Tex.

[73] Assignee: Halliburton Company, Duncan, Okla.

[21] Appl. No.: 22,158

[22] Filed: Mar. 5, 1987

[51] Int. Cl.[4] ..... F42B 3/00

[52] U.S. Cl. ..... 102/321; 102/312; 102/313; 102/320; 102/331

[58] Field of Search ..... 102/307, 312, 313, 320, 102/321, 331; 175/4.6

[56] References Cited

U.S. PATENT DOCUMENTS

| | | | |
|---|---|---|---|
| 3,078,797 | 2/1963 | Blair | 102/20 |
| 3,636,875 | 1/1972 | Dodson | 102/20 |
| 4,312,273 | 1/1982 | Camp | 102/310 |
| 4,326,462 | 4/1982 | Garcia et al. | 102/310 |
| 4,479,556 | 10/1984 | Stout et al. | 175/4.6 |
| 4,583,602 | 4/1986 | Ayers | 175/4.52 |
| 4,598,775 | 7/1986 | Vann et al. | 175/4.6 |
| 4,609,057 | 9/1986 | Walker et al. | 175/4.6 |
| 4,621,396 | 11/1986 | Walker et al. | 29/1.3 |
| 4,655,138 | 4/1987 | Regalbuto et al. | 102/307 |
| 4,716,833 | 1/1988 | Regalbuto | 102/320 |
| 4,739,707 | 4/1988 | Regalbuto et al. | 102/307 |

OTHER PUBLICATIONS

U.S. patent application Ser. No. 651,201 filed Sept. 17, 1984.

*Primary Examiner*—Peter A. Nelson

*Attorney, Agent, or Firm*—Mark E. McBurney; Lucian W. Beavers

[57] ABSTRACT

A shaped charge carrier assembly includes a thin wall carrier having a charge opening disposed therethrough for freely receiving a shaped charge therein. A deformable retaining device is integrally formed with the thin wall carrier adjacent a periphery of the charge opening. The deformable retaining device allows the shaped charge to initially be freely received in the charge opening, but subsequently retains the shaped charge in the charge opening upon deformation of the deformable retaining device.

42 Claims, 9 Drawing Sheets

SHAPED CHARGE CARRIER

BACKGROUND OF THE INVENTION

1. Field Of The Invention

The invention relates to a carrier for carrying shaped charges for use in an elongated perforating gun of the type generally used to perforate oil and gas wells. The invention also relates to the assembly of the carrier and the shaped charge, to the design of the shaped charge, and to methods of assembling carriers and shaped charges. The invention particularly pertains to the manner in which the shaped charge is held in place relative to the carrier of the perforating gun.

2. Description Of The Prior Art

Perforating guns commonly used in wire line and tubing conveyed service operations for perforating an oil or gas well typically include an elongated cylindrical outer housing within which is received an elongated carrier which has a number of shaped charges in place in the carrier. The carrier is located relative to the housing so as to locate each of the shaped charges adjacent reduced thickness portions of the housing.

A number of techniques have been utilized for holding shaped charges within a carrier.

Lug and slot type connection means have been utilized as shown in U.S. Pat. No. 3,078,797 to Blair wherein the lugs of a shaped charge are inserted through an opening adjacent a carrier, and then the shaped charge is rotated to lock it in place relative to the carrier.

Also, wire-type carriers have been utilized wherein the shaped charge has spaced shoulders which receive the carrier wires therebetween, as shown in U.S. Pat. No. 3,636,875 to Dodson.

A number of different techniques have utilized shaped charges having shoulders which rest against a carrier, in combination with separate attachment means such as screws, clips or the like. These are seen for example in U.S. Pat. Nos. 4,326,462 to Garcia et al.; 4,479,556 to Stout et al.; 4,312,273 to Camp; 4,543,703 to Wetzel et al.; and 4,541,486 to Wetzel et al.

More recently, the assignee of the present invention has developed a system in which the carrier includes resilient tab means extending into openings for receiving the shaped charges. The resilient tab means frictionally engage the shaped charge as it is pushed into the opening and thereby hold the shaped charge in place within the opening. Such structures are shown for example in U.S. application Ser. No. 651,201, filed Sept. 17, 1984; U.S. Pat. No. 4,609,057; and U.S. Pat. No. 4,621,396, all assigned to the assignee of the present invention.

From these various examples just discussed, it is seen that the prior art has long recognized the need for a reliable means for retaining shaped charges in place within the carrier of a perforating gun. The present invention provides a much improved, very economical, reliable, and easily assembled construction for the assembly of a shaped charge with a carrier.

SUMMARY OF THE INVENTION

The shaped charge carrier apparatus of the present invention includes a thin wall carrier having a charge opening disposed therethrough for freely receiving a shaped charge therein. A deformable retaining means is integrally formed with the thin wall carrier adjacent a periphery of the charge opening, for initially allowing the shaped charge to be freely received in the charge opening, and for subsequently retaining the shaped charge in the charge opening upon deformation of the deformable retaining means.

Furthermore, this carrier design is particularly adaptable for use on a cylindrical tubular carrier and provides a means for mounting the shaped charges which reliably holds the shaped charges in a radial orientation relative to the carrier.

This permits openings to be formed in any desired pattern on the tubular carrier for mounting of the shaped charges.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is a side elevation view of the structure seen in FIG. 5.

FIG. 9 is a plan sectioned view taken along line 9—9 of FIG. 8 showing the complete cylindrical carrier in cross section with three shaped charges in place therein.

DETAILED DESCRIPTION OF THE INVENTION

General Description Of The Perforating Gun

Figure 1:
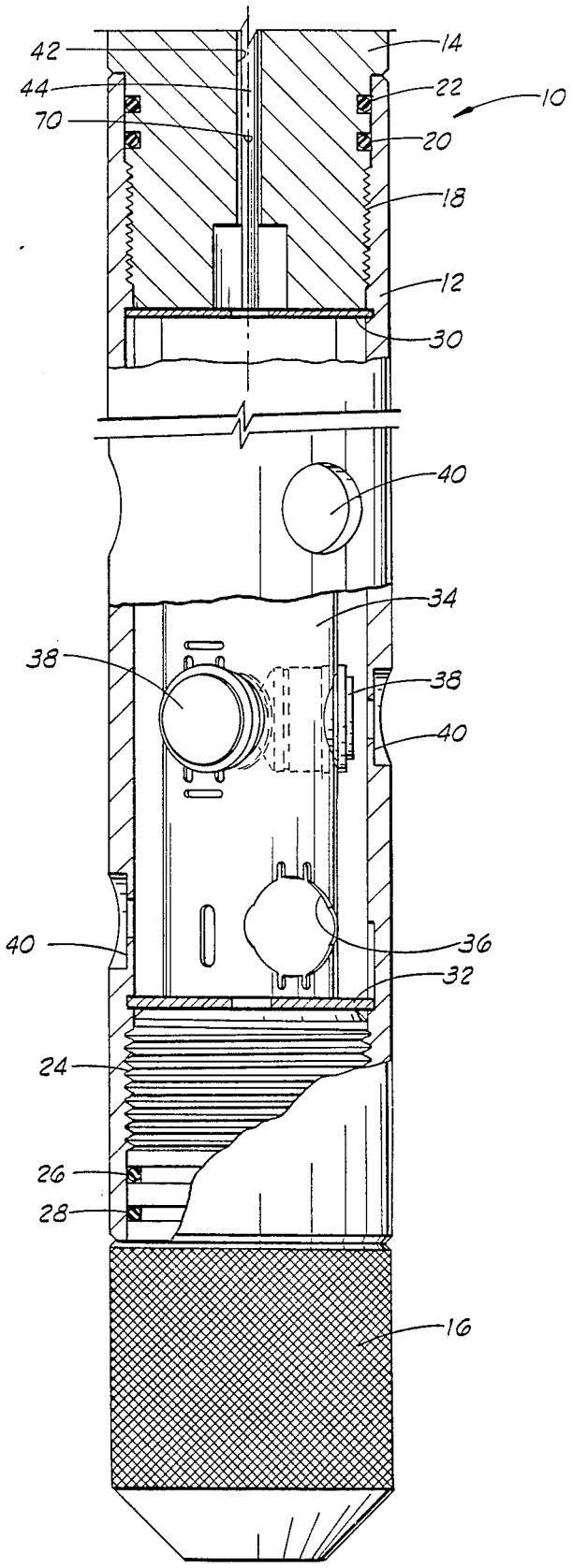
FIG. 1 is an elevation, partly sectioned view of a perforating gun showing a carrier in place within the perforating gun, with a plurality of shaped charges in place within the carrier.

Referring now to the drawings, and particularly to FIG. 1, a perforating gun is thereshown and generally designated by the numeral 10. The perforating gun 10 includes an elongated cylindrical outer housing 12, the upper end of which is closed by a top plug 14 and the lower end of which is closed by a bottom plug 16.

Top plug 14 is threadedly connected to housing 12 at threaded connection 18 and a seal is provided therebetween by the O-rings 20 and 22. The bottom plug 16 is threadedly connected to housing 12 at the threaded connection 24 and a resilient seal is provided therebetween by O-rings 26 and 28.

In place within the housing 12 adjacent the lower end of top plug 14 and the upper end of bottom plug 16 are upper and lower carrier mounting plates 30 and 32, respectively.

Held in place between the upper and lower mounting plates 30 and 32 is an elongated charge carrier 34. The carrier 34 illustrated in FIG. 1 is a cylindrical charge carrier having a pattern of openings like that further illustrated in FIGS. 7–10, but it will be understood that any of the various charge carriers disclosed herein might be utilized with a perforating gun like the perforating gun 10.

Also, it is noted that the present invention is applicable to charge carriers used without an enclosed housing. Such unenclosed charge carriers are used with shaped charges which are themselves constructed so as to withstand the downhole environment.

The carrier 34 has disposed through the walls thereof a plurality of charge openings 36 for receiving shaped charges 38 therein.

The carrier 34 is attached to the end plates 30 and 32 in such a manner as to specifically define its orientation about its longitudinal axis relative to the housing 12, so that each of the shaped charges 38 is located immediately adjacent a reduced thickness portion 40 of the housing 12 in a manner well known to those skilled in the art.

Disposed through a central opening 42 of top plug 14 is a firing means 44 which generally comprises a length of detonating cord and associated apparatus for firing the shaped charges 38 in response to an electrical signal directed down a wire line (not shown) from a surface location at the top of the oil well which is being perforated. As will be understood by those skilled in the art, the firing means 44 extends downward through the carrier 34 and is operatively connected to each of the shaped charges 38.

It will be further apparent from the following description that the present invention can be used with any shape carrier, e.g., round tubular carriers, polygonal cross section tubular carriers, flat strip type carriers, or the like. Furthermore, on tubular carriers the charge openings and shaped charges can be arranged in any desired pattern, e.g., spiraled, multiple spirals, staggered layers, etc.

The Embodiment Of FIGS. 2–6

In the embodiment of FIGS. 2–6, the carrier is designated as 34A, the charge openings are designated as 36A, and the shaped charges themselves are designated as 38A, corresponding to the general designations 34, 36 and 38 shown in FIG. 1.

Figure 2:
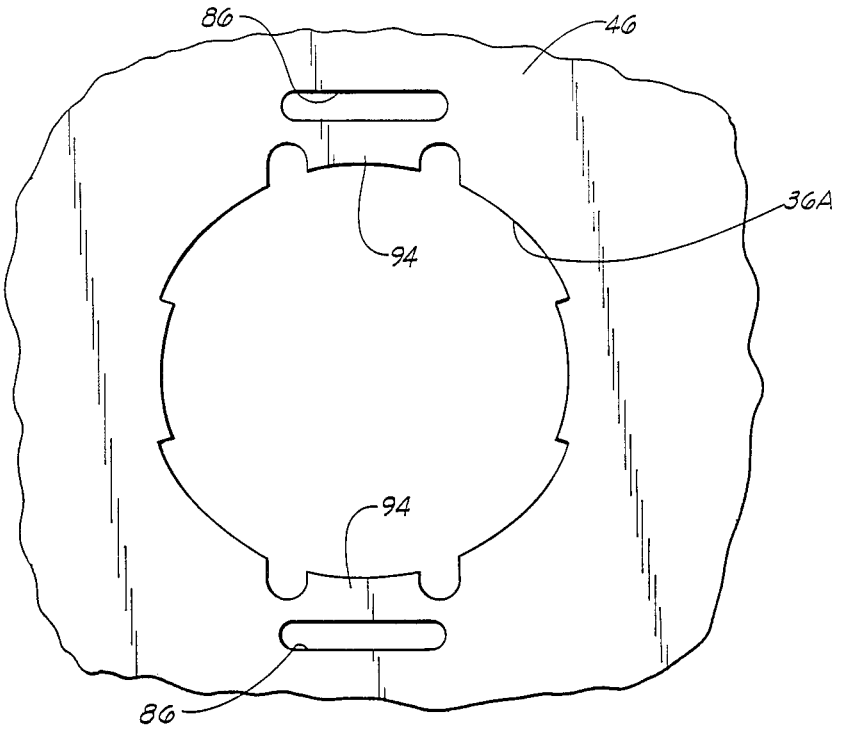
FIG. 2 is a flat development of one embodiment of the charge opening used in the shaped charge carrier of the present invention.

In FIG. 2, the original shape of the charge opening 36A is shown as it is formed in a flat thin wall sheet 46. A number of such openings will be formed in the flat sheet 46, and then the sheet 46 is rolled to a cylindrical configuration as seen in cross section in FIG. 4 thus forming the cylindrical thin wall carrier 34A.

Figure 4:
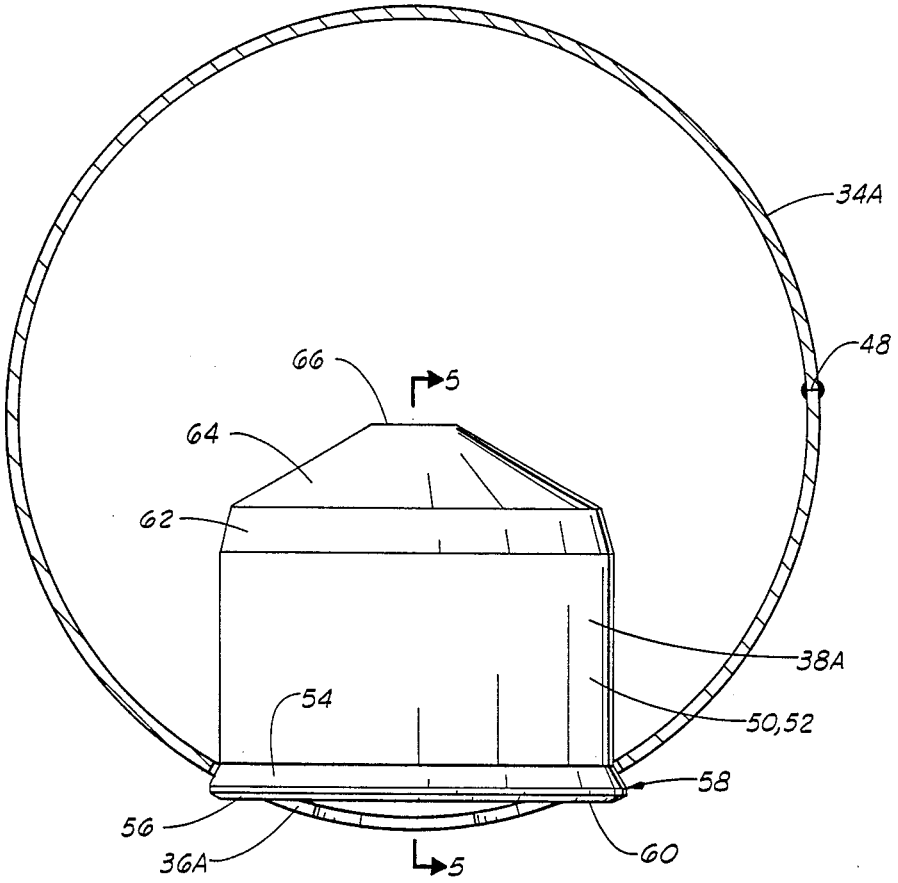
FIG. 4 is a plan sectioned view taken along line 4—4 of FIG. 3 showing in section the entire tubular carrier, only a portion of which is shown in FIG. 3.

As seen in FIG. 4, the ends of the flat sheet 46 have been joined together at 48 and spot-welded.

Figure 3:
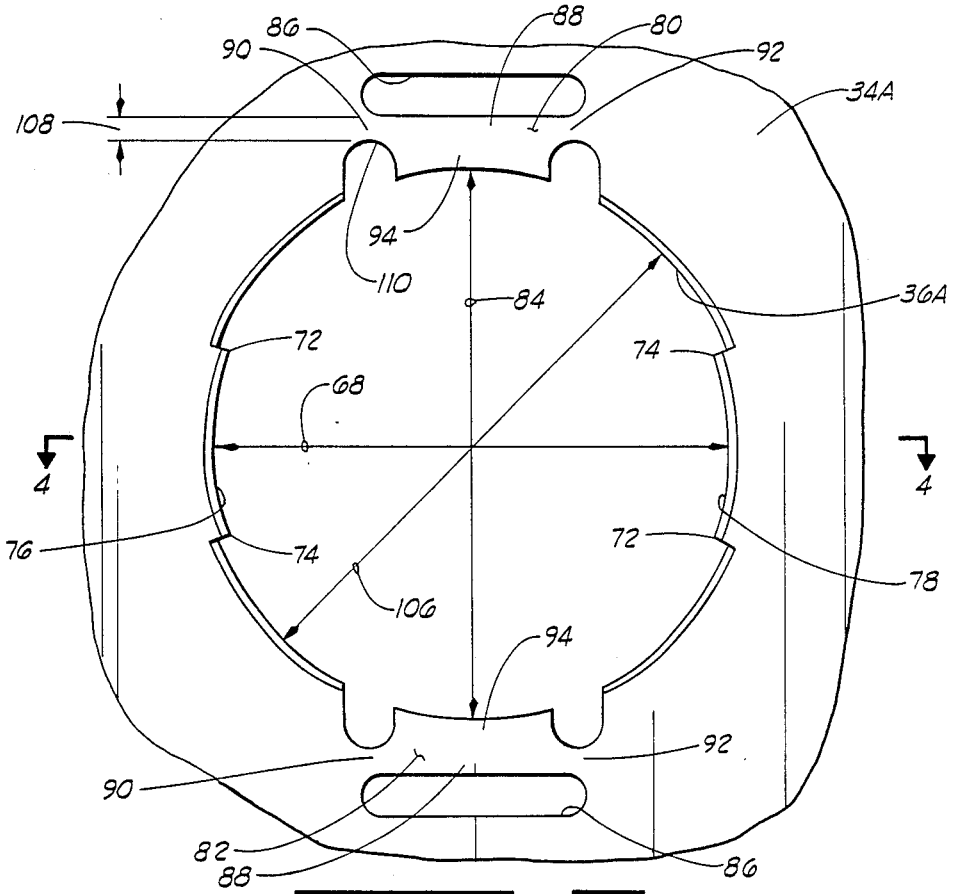
FIG. 3 shows the carrier of FIG. 2 after having been rolled into a cylindrical configuration. It is noted that FIG. 3 is drawn to a somewhat larger scale than FIG. 2, although the same opening is illustrated in both figures.
Figure 5:
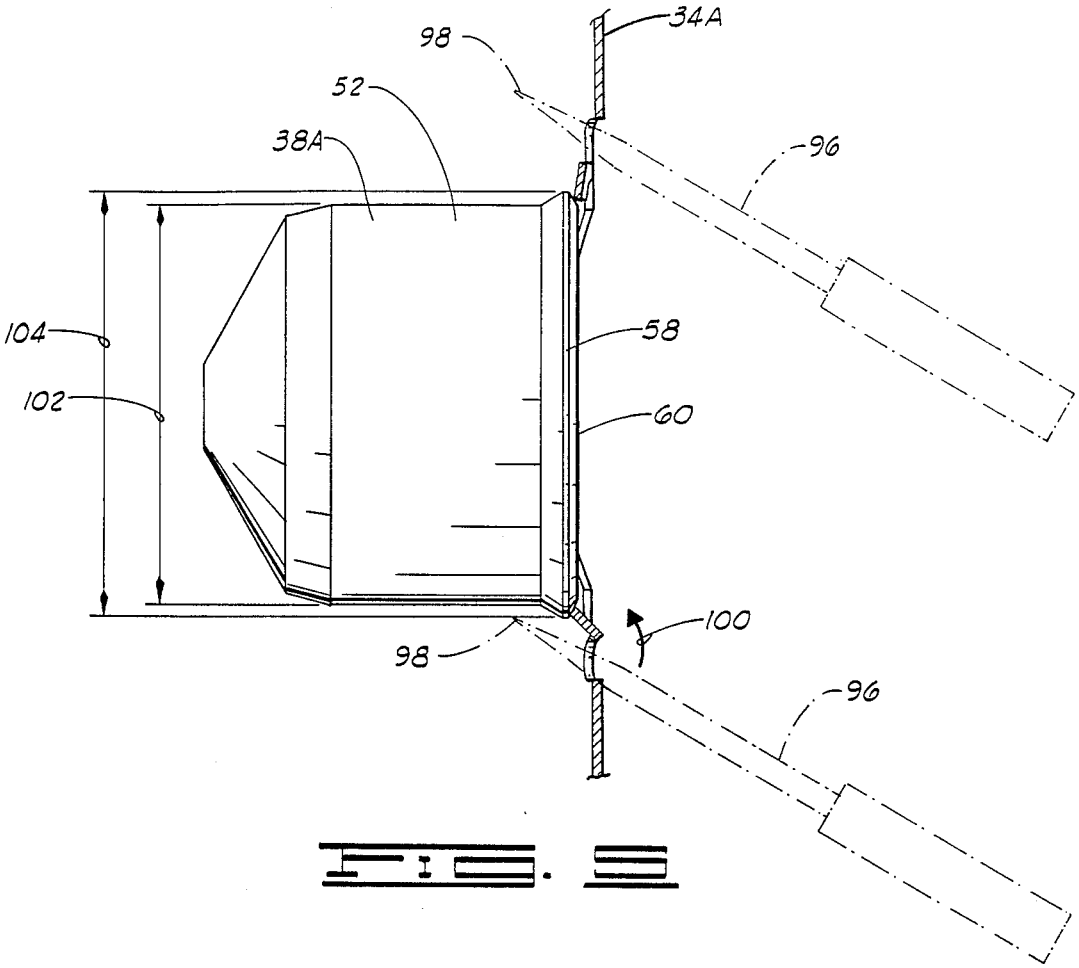
FIG. 5 is an elevation sectioned partial view taken along line 5—5 of FIG. 4 illustrating the manner in which the shaped charge is held within the charge opening of the carrier.
Figure 5:
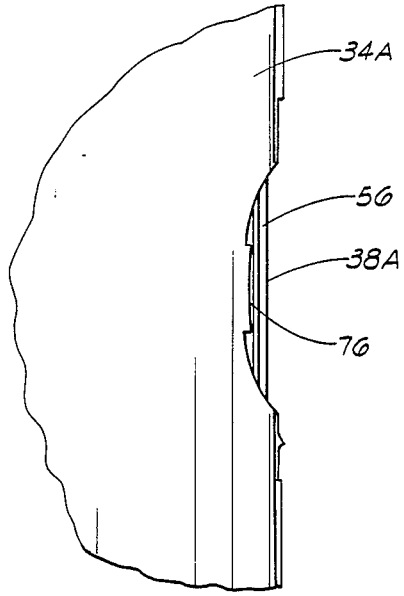
Figure 7:
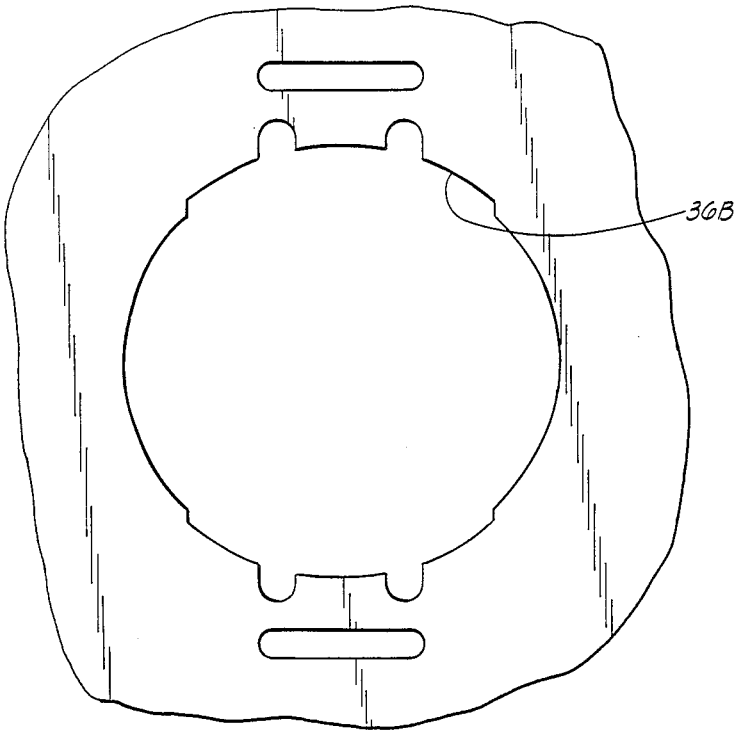
FIG. 7 is a flat development similar to FIG. 2, showing a modified shape for the charge opening.

FIG. 3 shows an enlarged elevation partial view of the cylindrical carrier 34A showing one of the charge openings 36A in elevation. FIG. 5 is a sectioned elevation partial view taken along 5—5 of FIG. 4 which further illustrates the manner in which the shaped charge 38A is held within the charge opening 36A of charge carrier 34A.

The shaped charge 38A includes an outer case 50 having a generally cylindrical outer surface 52. First and second oppositely facing tapered annular enlarged diameter shoulders or outer surfaces 54 and 56, respectively, define an enlarged diameter flange means 58 adjacent a radially outer end 60 of shaped charge 38A.

The shaped charge 38A further includes first and second tapered frustoconical reduced diameter portions 62 and 64, and a radially inner end 66.

The charge opening 36A of carrier 34A is a substantially circular charge opening (as best seen in FIG. 3) which is large enough to receive the generally cylindrical outer surface 52 of the case 50 with the first annular shoulder 54 abutting the carrier 34A.

The substantially circular charge opening 36A has a reduced diameter portion at diameter 68. The reduced diameter portion 68 is located approximately in and adjacent a plane normal to a longitudinal central axis 70 (see FIG. 1) of the tubular carrier 34A. This results in the first annular shoulder 54 of shaped charge 38A abutting the carrier 34A at two pairs of diametrically opposed points 72 and 74 on an inner periphery of the reduced diameter portion 68 of the charge opening 36A. Thus, the first annular shoulder 54 rests on four points of support along the periphery of the charge opening 36A.

The reduced diameter portion 68 of charge opening 36A is formed by two diametrically opposed arcuate edge portions 76 and 78 along the periphery of charge opening 36A, and the points 72, 74 are defined as the circumferential ends 72, 74 of each of the arcuate edge portions 76 and 78.

Integrally formed with and permanently attached to the carrier 34A adjacent the periphery of the charge opening 36A are first and second diametrically opposed deformable retaining means 80 and 82.

The charge opening 36A initially has a diametrical clearance 84 between the first and second deformable retaining means 80 and 82, sufficiently large that the generally cylindrical outer surface 52 of shaped charge 38A may be freely received therebetween.

Upon subsequent deformation of the first and second deformable retaining means 80 and 82, as further described below, the deformable retaining means 80 and 82 will move further into the charge opening 36A to retain the shaped charge 38A in place within the charge opening 36A as best illustrated in FIG. 5.

The carrier 34A has a plurality of tool receiving apertures such as 86 disposed therethrough adjacent each of the deformable retaining means such as 80 and 82, so that the deformable retaining means 80 and 82 are at least partially defined between the tool receiving apertures 86 and the charge opening 36A. As seen in FIGS. 1 and 2, the tool receiving apertures 86 are completely separate from the charge opening 36A in this embodiment, although they need not be so completely separate in the broader concepts of the invention.

The deformable retaining means such as 80 and 82 each include a relatively flexible beam portion 88 having two ends 90 and 92, both of which are integrally formed with and fixed to the thin wall carrier 34A. The beam portion 88 is defined between the tool receiving aperture 86 and the charge opening 36A.

The deformable retaining means 80 and 82 each further include a tab portion 94 attached to the beam portion 88 between the two ends 90 and 92 thereof. The tab portion 94 extends from the beam portion 88 toward the charge opening 36A.

The tool receiving apertures 86 are further defined as elongated slots oriented substantially parallel to a length of the beam portion 88 of the deformable retaining means 80, and substantially tangential to a closest point on the periphery of charge opening 36A.

Referring now to the lower portion of FIG. 5, the beam portion 88 of the lower deformable retaining means 94 is torsionally flexible so that upon insertion of a thin bladed tool, such as the screwdriver 96 shown in phantom lines, into the tool receiving aperture 86 and rotation of said tool about an axis of rotation parallel to the length of the beam portion 88 of deformable retaining means 82, with an inserted end 98 of the tool 96 moving toward the charge opening 36A, the beam portion 88 of flexible retaining means 82 is bowed toward the charge opening 36A, and the beam portion 88 of deformable retaining means 82 is also torsionally rotated in a direction 100 opposite to that in which the tool 96 was rotated, thus moving the tab portion 94 away from a plane of the thin wall carrier 34A in the same direction as which the tool 96 was inserted into the tool receiving aperture 86, i.e., radially inward relative to the cylindrical carrier 34A.

A second manner of deforming the deformable retaining means such as 80 and 82 is illustrated at the upper part of FIG. 5 with regard to the upper deformable retaining means 80. By rotating the tool 96 such that its inserted end 98 moves away from the shaped charge 38A, the deformable retaining means 80 is deformed in a very different manner.

When the tool 96 is rotated about an axis parallel to the length of the beam portion 88 of upper deformable retaining means 80 with the inserted end 98 moving away from the charge opening 36A, the beam portion 88 is bowed toward the charge opening 36A so that the tab portion 94 extends into the charge opening 36A, and the beam portion 88 is further bowed away from the plane of the thin wall carrier 34 radially inward to engage and hold the shoulder 56 of the radially outer end 60 of the shaped charge 38A.

As is seen in FIG. 6, a distance between the first and second shoulders 54 and 56 is such that, and the carrier 34A and charge opening 36A are so dimensioned that, when the first annular shoulder 54 abuts the four support points 72, 74 on the periphery of the reduced diameter portion 68 of the charge opening 36A, the second annular shoulder 56 is located radially inward of the deformable retaining means 80 and 82. With this construction, upon subsequent deformation of the deformable retaining means 80 and 82 longitudinally into the charge opening 36A and radially inward against the second annular shoulder 56, the shaped charge 38A is held between the four support points 72, 74 and the two deformable retaining means 80 and 82.

It is noted that although the deformable retaining means 80 and 82 are shown in this embodiment as initially extending toward the opening 36A in a direction substantially parallel to the axis 70, they need not be so oriented. For example, similar deformable retaining means could be located at approximately the location of arcuate edge portions 76 and 78, and could be engaged with an undercut groove (not shown) in the outer surface of a shaped charge in a manner analogous to that shown in FIG. 14.

EXAMPLE

Now by way of specific example, typical dimensions will be provided for one size of the charge opening 36A seen in FIG. 3.

For the shaped charge 38A of FIG. 5 having an outside diameter 102 of 1.700 inch along its generally cylindrical outer surface 52, and for a outside diameter 104 of flange means 58 of 1.800 inch, the dimensions of the charge opening 36A of FIG. 3 are as follows.

The charge opening 36A has a nominal inside diameter 106 of 1.820 inch. The reduced diameter portion 68 of charge opening 36A has a reduced diameter of 1.715 inch. The diameter 84 between the tabs 94 is 1.820 inch prior to deformation of the deformable retaining means 80 and 82.

The tool receiving slot shaped apertures 86 have a length of $\frac{3}{4}$ inch and a width of $\frac{1}{8}$ inch. A distance 108 between the aperture 86 and the root 110 of the indentations defining the tabs 94 is 0.090 inch. Further, the thin wall carrier 34A is formed from a 16 Ga A366 cold rolled steel.

The Embodiment of FIGS. 7–10

FIGS. 7–10 illustrate an embodiment of the present invention similar to that shown in FIGS. 2–6, but constructed for use with a modified shaped charge 38B best seen in FIG. 9.

The shaped charge 38B has a generally cylindrical outer surface 122 defined along the length thereof. First and second oppositely facing annular shoulders 124 and 126 define a radially outwardly extending flange means 128 located intermediately along the length of the shaped charge 38B.

Figure 8:
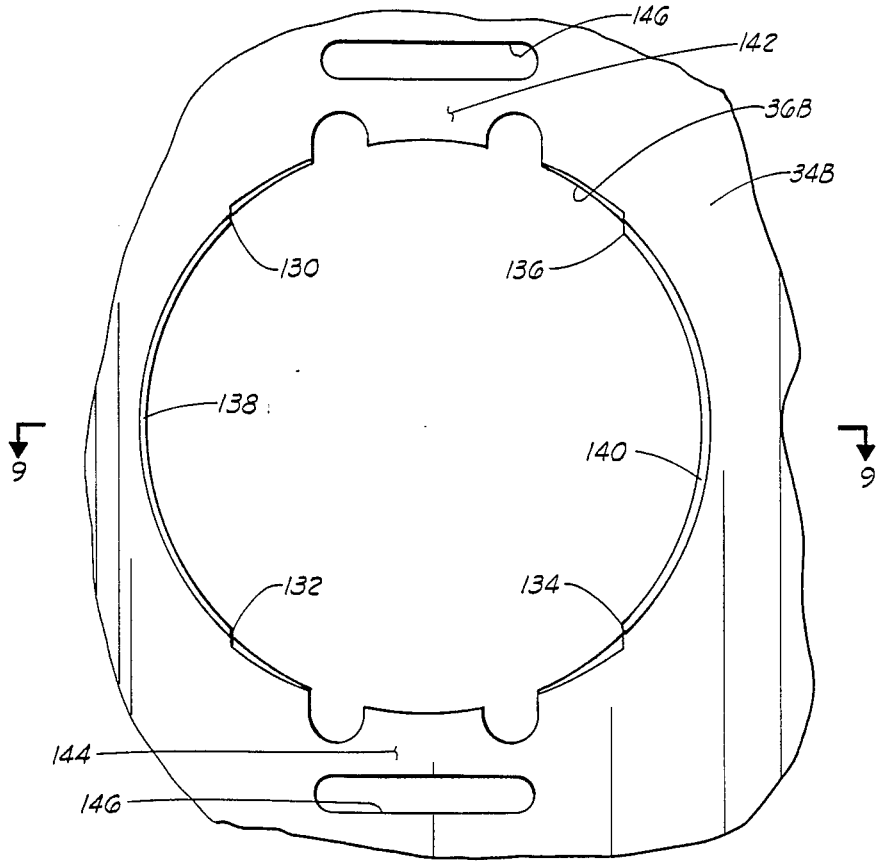
FIG. 8 shows the structure of FIG. 7 having been rolled into a cylindrical carrier configuration. It is noted that FIG. 8 is drawn to a somewhat larger scale than FIG. 7, although the same opening is illustrated in both figures.
Figure 3:
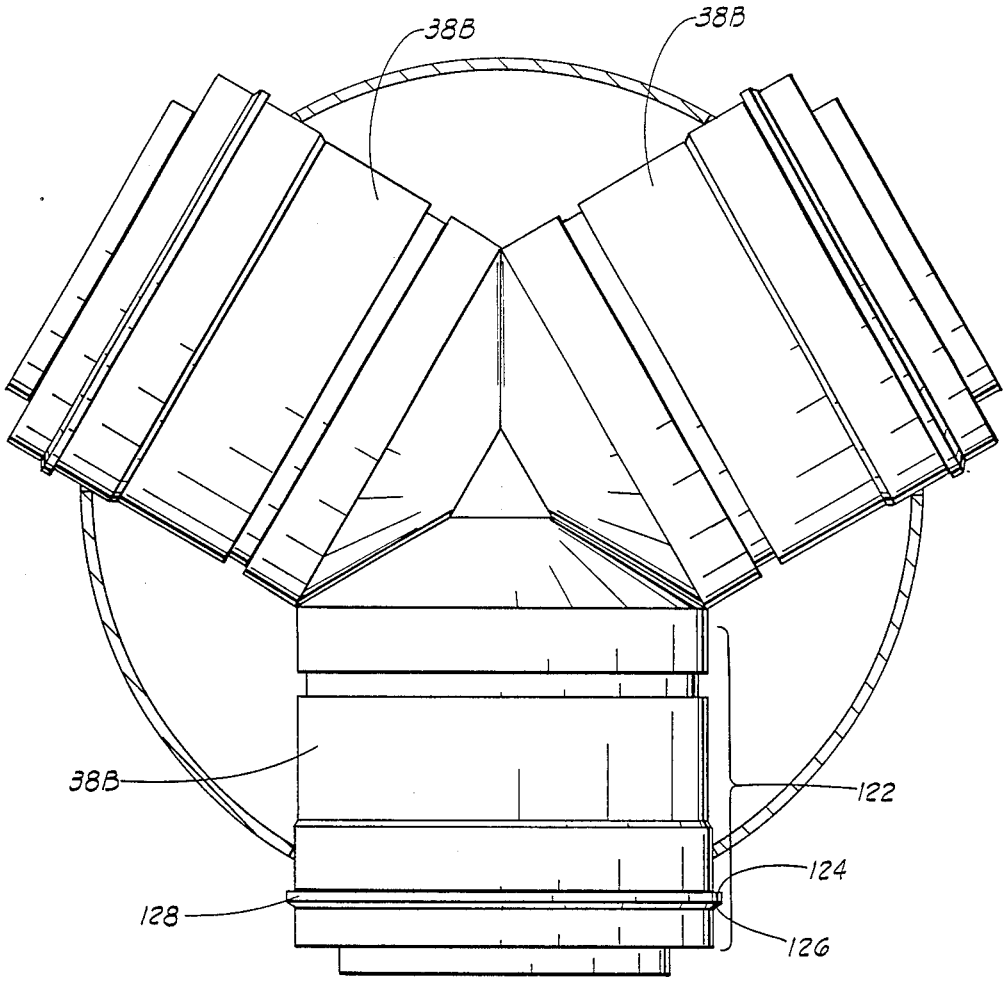
Figure 10:
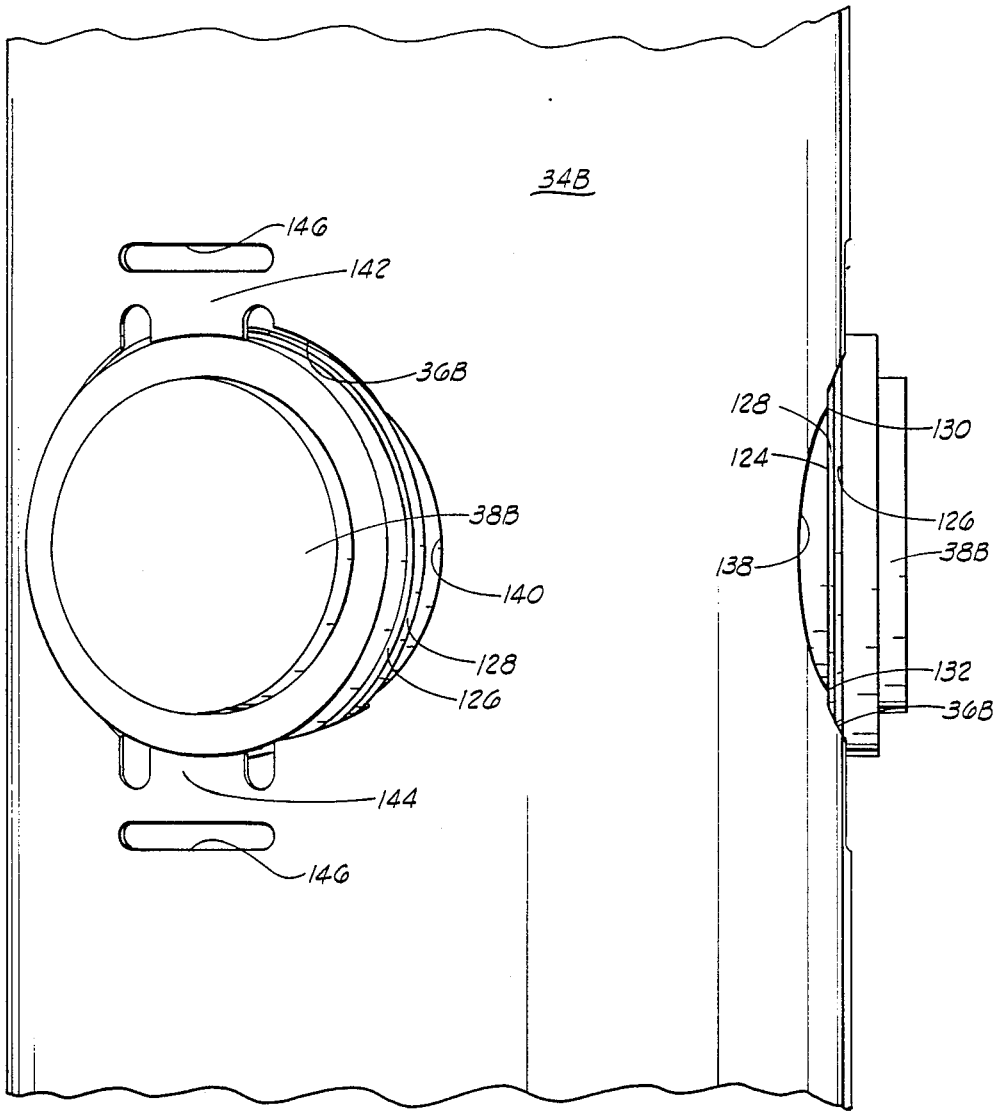
FIG. 10 is an elevation view of the structure of FIG. 9.

The first annular shoulder 124 of flange means 128 rests on the four circumferential end points 130, 132, 134 and 136 of reduced diameter arcuate edge portions 138 and 140 of the generally circular charge opening 36B as seen in FIG. 8. The end points 130, 132, 134 and 136 can generally be referred to four points of support for the first annular shoulder 124 of shaped charge 38B.

Upper and lower deformable retaining means 142 and 144 are constructed generally similar to the deformable retaining means 80 and 82 previously described with regard to FIG. 3. Similar tool receiving apertures 146 are also provided.

In the embodiment of FIGS. 7–10, the arcuate reduced diameter edge portions 138 and 140 are considerably longer in their circumferential span, to accommodate the modified shaped charge 38B.

Figure 11:
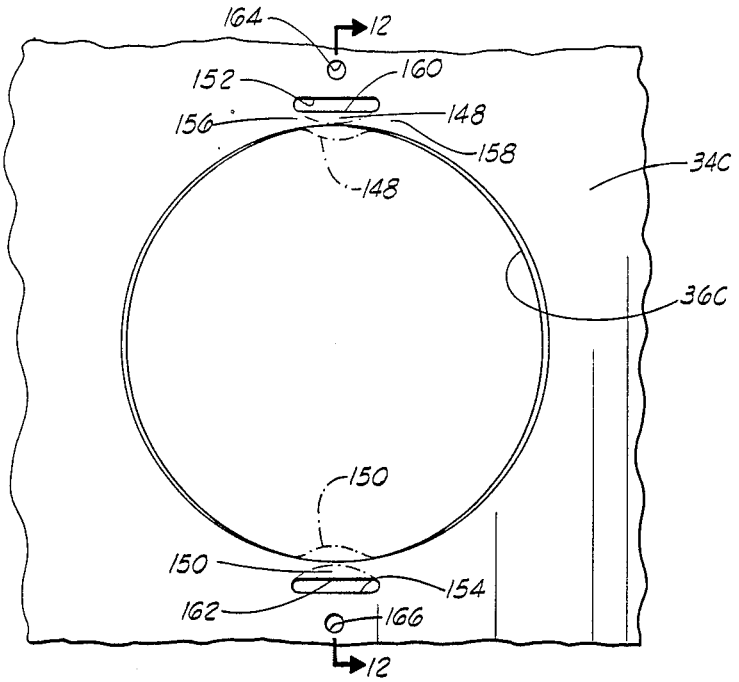
FIG. 11 shows a third embodiment of the charge opening of the carrier of the present invention. The embodiment in FIG. 11 is shown on a cylindrical carrier, only a portion of which is illustrated.
Figure 12:
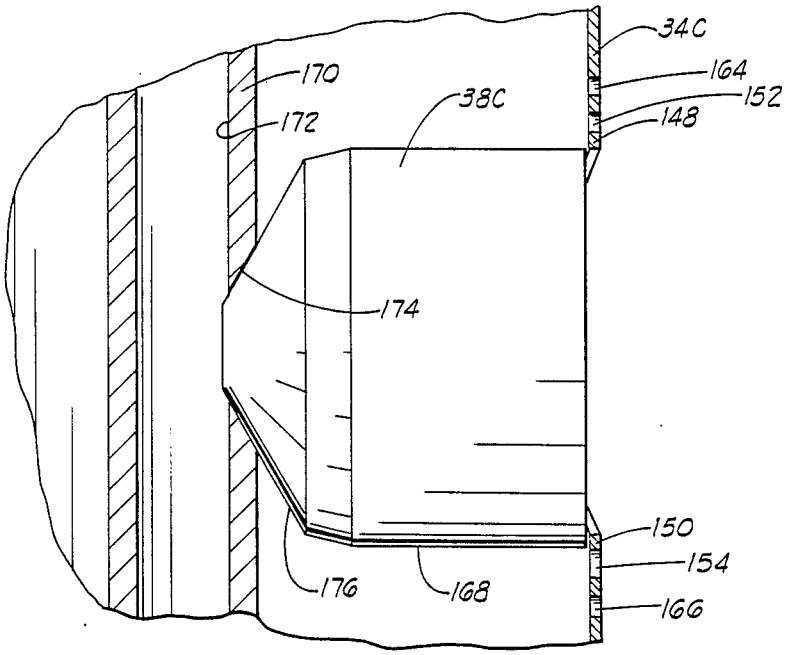
FIG. 12 is an elevation sectioned view of the structure of FIG. 11 taken along line 12—12 of FIG. 11, and also shows in cross section an internal support tube located concentrically within the cylindrical carrier of FIG. 11.

The Embodiment Of FIGS. 11 And 12

Another embodiment of the present invention is shown in FIGS. 11 and 12, which provides another form of cylindrical tubular charge carrier 34C for receiving a modified shaped charge 38C in a charge opening 36C.

The charge opening 36C seen in elevation in FIG. 11 is a substantially uninterrupted circle of uniform diameter. Tool receiving apertures 152 and 154 are also provided. Upper and lower deformable retaining means 148 and 150 are defined between the tool receiving apertures 152 and 154, respectively, and the circular charge receiving opening 36C.

Each of the upper and lower deformable retaining means 148 and 150 includes a relatively flexible beam portion having two ends such as 156 and 158 which are integrally formed with and fixed to the thin wall carrier 34C.

The relatively flexible beam portion of each of the upper and lower deformable retaining means 148 and 150 are deformable into the charge opening 36C upon application of a force to a mid portion such as at points 160 and 162, thereof, said force being directed from the tool receiving apertures 12 and 154 toward the charge opening 36C.

A suitable tool for deforming the deformable retaining means 148 and 150 of FIG. 11 is a flat bladed screwdriver having a 90° bend in the shank of the tool. The flat blade of the screwdriver can be inserted into the tool receiving aperture 152 or 154 and then rotated about an axis extending radially relative to the cylindrical carrier 34C to bow the deformable retaining means 148 and 150 outward into the shapes indicated in phantom lines in FIG. 11.

The carrier 34C further includes second tool receiving openings 164 and 166 associated with the upper and lower deformable retaining means 148 and 150, respectively. The second tool receiving openings are spaced from the elongated slots 152 and 154 on a side thereof opposite the charge opening 36C so that a pair of pliers or the like can be engaged with the second tool receiving openings such as 164 and the beam portion of the deformable retaining means to deform the beam portion away from the charge opening and back toward its initial position.

These second tool receiving openings 164 and 166 are utilized in the manner described above to allow the shaped charge 36C to be removed from the carrier 34C.

FIG. 12 is an elevation sectioned partial view taken along line 12—12 of FIG. 11 showing the shaped charge 38C in place within the carrier 34C and illustrating how the deformable retaining means 148 and 150 function. The upper retaining means 148 has not yet been deformed. The lower retaining means 150 has been deformed in FIG. 12 to a position like that shown in phantom lines in FIG. 11. When the upper retaining means 148 is also deformed inward, the shaped charge 38C will be securely held within the carrier 34C.

The shaped charge 38C has a generally cylindrical outer surface 168 the entirety of which can be received through the initially circular opening 36C.

The cylindrical carrier 34C has associated therewith an inner charge holder tube 170 shown in cross section which is located concentrically within the cylindrical carrier 34C. The tube 170 has a longitudinal axial bore 172 disposed therethrough for receiving a prima cord or the like. The charge holder tube 170 further includes a plurality of frustoconical radially oriented openings such as 174 for receiving a complimentary angled frustoconical nose portion 176 of the shaped charge 38C.

After the nose portion 176 is nested into the opening 174, the upper and lower deformable retaining means 148 and 150 are deformed to the position shown in phantom lines in FIG. 11 and the shaped charge 38C is thus held in place within the carrier 34C.

Figure 13:
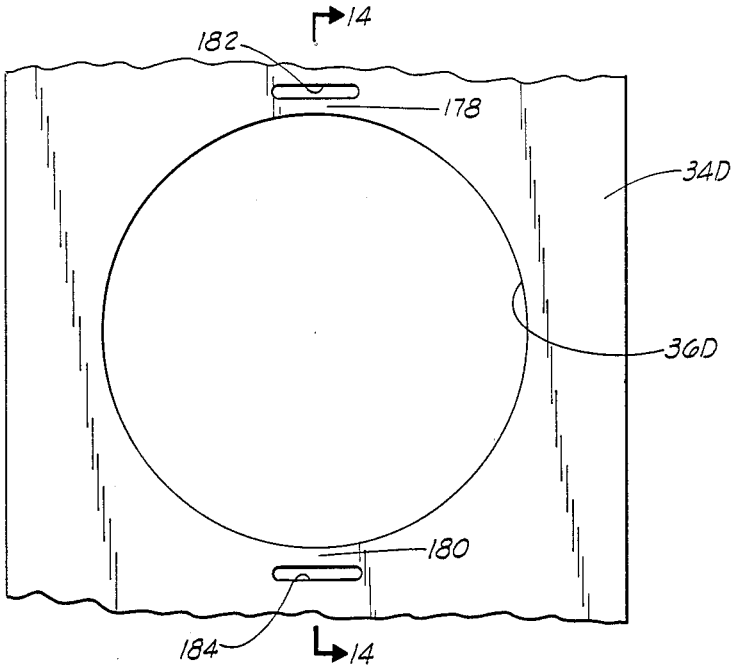
FIG. 13 shows a charge opening similar to that of FIG. 11, in place within a flat strip-type carrier.
Figure 14:
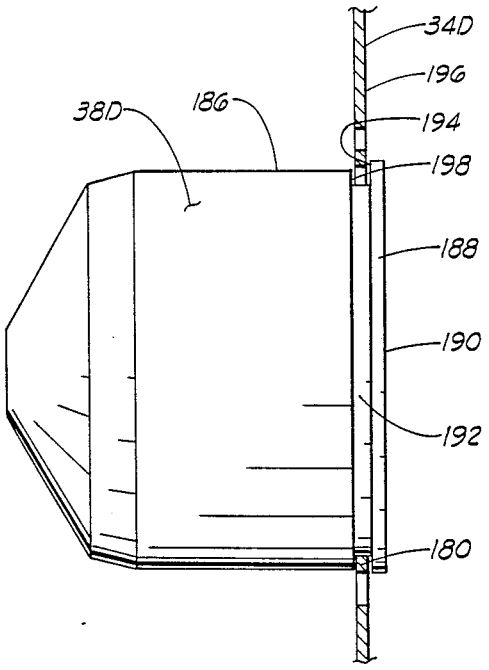
FIG. 14 is an elevation sectioned view taken along line 14—14 of FIG. 13 showing a shaped charge held in place within the flat strip-type carrier of FIG. 13.

The Embodiment Of FIGS. 13 And 14

FIGS. 13 and 14 show a charge receiving opening 36D somewhat similar to the charge receiving opening 36C of FIG. 11, in that the charge receiving opening 36D is a substantially uniform circle of constant diameter. The carrier 34D is a flat strip type carrier.

Upper and lower deformable retaining means 178 and 180 are defined between the charge opening 36D and upper and lower tool receiving apertures 182 and 184 in a manner similar to that previously described.

As seen in FIG. 14, a shaped charge 38D has a generally cylindrical outer surface 186 with an enlarged diameter flange 188 defined at a radially outer end 190 thereof, with an undercut groove 192 of reduced diameter adjacent the flange 188.

The circular flange 188 has a diameter greater than the diameter of the circular charge opening 36D so that a first annular shoulder or surface 194 thereof abuts the surface 196 of charge carrier 34D upon insertion of the shaped charge 38D into the opening 36D. Subsequently, the deformable retaining means 178 and 180 are bowed into the circular opening 36D and received within the groove 192.

In FIG. 14, the lower deformable retaining means 180 is shown in a deformed position wherein it is received within the groove 192.

One side of the groove 192 is defined by a second annular shoulder 198 of shaped charge 38D, and this second annular shoulder 198 will engage the upper and lower deformable retaining means 178 and 180 to retain the shaped charge 38D in place in the charge opening 36D.

SUMMARY

Thus, it is seen that the apparatus and methods of the present invention readily achieve the ends and advantages mentioned as well as those inherent therein. While certain preferred embodiments of the invention have been illustrated and described for purposes of he present disclosure, numerous changes in the arrangement and construction of parts and steps may be made by those skilled in the art, which changes are encompassed within the scope and spirit of the present invention as defined by the appended claims.

What is claimed is:

1. A shaped charge carrier assembly apparatus for use in a perforating gun, comprising:

at least one shaped charge including an outer case, said case having a generally cylindrical outer surface joined by a first inwardly tapered surface which is joined by a second inwardly tapered surface extending to an end of said shaped charge;

inner charge holder means for receiving said second inwardly tapered surface of said shaped charge outer case and providing support to said shaped charge;

a tubular thin wall carrier with a substantially circular cross-section and having a substantially circular charge opening disposed therethrough large enough to receive said shaped charge outer case, deformable retaining means, permanently attached to said carrier adjacent a periphery of said charge opening, for engaging said shaped charge at an end opposite said second tapered surface upon deformation of said deformable retaining means to thereby retain said shaped charge in said charge opening; and at least one tool insertion aperture, disposed through said carrier, adjacent said deformable retaining means so that said deformable retaining means is at least partially defined between one of said tool insertion aperture and said charge opening.

2. A shaped charge carrier apparatus comprising:

a thin wall carrier having a charge opening disposed therethrough for freely receiving a shaped charge therein, said thin wall carrier also having a tool receiving aperture disposed therethrough; and deformable retaining means, integrally form®d in said thin wall carrier adjacent a periphery of said charge opening, for initially allowing said shaped charge to be freely received in said charge opening and for subsequently retaining said shaped charge in said charge opening upon deformation of said deformation retaining means, said deformable retaining means disposed adjacent said tool receiving aperture so that said deformable retaining means is at least partially defined between said tool receiving aperture and said charge opening.

3. The apparatus of claim 2, wherein:

said tool receiving aperture is completely separate from said charge opening.

4. The apparatus of claim 2, wherein:

said deformable retaining means includes a relatively flexible beam portion having two ends both of which are integrally fixed to said thin wall carrier, said beam portion being defined between said tool receiving aperture and said charge opening.

5. The apparatus of claim 4, wherein:

said deformable retaining means further includes a tab portion integrally attached to said beam portion between the two ends thereof, said tab portion extending from said beam portion toward said charge opening.

6. The apparatus of claim 5, wherein:

said tool receiving aperture is an elongated slot oriented substantially parallel to a length of said beam portion of said deformable retaining means.

7. The apparatus of claim 6, wherein:

said beam portion of said deformable retaining means is further characterized as being torsionally flexible, so that upon insertion of a thin bladed tool into said tool receiving aperture and rotation of said tool about an axis parallel to said length of said beam portion with an inserted end of said tool moving toward said charge opening, said beam portion is bowed toward said charge opening so that said tab portion extends into said charge opening, and said beam portion is torsionally rotated in a direction opposite to that in which said tool was rotated, thus moving said tab portion away from a plane of said thin wall carrier in the same direction as which said tool was inserted into said tool receiving aperture.

8. The apparatus of claim 6, wherein:

said beam portion of said deformable retaining means is further characterized as being sufficiently flexible that upon insertion of a thin bladed tool into said tool receiving aperture and rotation of said tool about an axis parallel to said length of said beam portion with an inserted end of said tool moving away from said charge opening, said beam portion is bowed toward said charge opening so that said tab portion extends into said charge opening, and said beam portion is further bowed away from a plane of said thin wall carrier in the same direction as which said tool was inserted into said tool receiving aperture.

9. The apparatus of claim 6, wherein:

said thin wall carrier is a tubular carrier of substantially circular cross section.

10. The apparatus of claim 4, wherein:

said relatively flexible beam portion of said deformable retaining means is further characterized as being deformable into said charge opening upon application of a sufficient force to a mid portion thereof, said force being directed from said tool receiving aperture toward said charge opening.

11. The apparatus of claim 10, wherein:

said tool receiving aperture is an elongated slot oriented substantially tangential to a closest point of said periphery of said charge opening.

12. The apparatus of claim 11, wherein:

said thin wall carrier further includes a second tool receiving opening disposed therethrough and spaced from said elongated slot on a side thereof opposite said charge opening, so that a pair of pliers or the like can be engaged with said second tool receiving opening and said beam portion of said deformable retaining means to deform said beam portion away from said charge opening.

13. The apparatus of claim 2, wherein:

said deformable retaining means includes a relatively flexible beam portion having at least one end thereof integrally fixed to said thin wall carrier, said beam portion being deformable into said charge opening upon application of a sufficient force thereto directed toward said charge opening.

14. The apparatus of claim 2, wherein:

said thin wall carrier is a tubular carrier of substantially circular cross section.

15. The apparatus of claim 2, wherein:

said charge opening is further characterized as being a substantially circular charge opening; and said apparatus further comprises:

at least two of said deformable retaining means; and at least two support means, integrally formed in said thin wall carrier and defining portions of said periphery of said charge opening, for supporting a shoulder of said shaped charge, so that said shaped charge is held between said at least two support means and said at least two deformable retaining means upon deformation of said deformable retaining means.

16. The apparatus of claim 2, further comprising:

at least one additional deformable retaining means peripherally spaced about said charge opening from said first mentioned deformable retaining means.

17. A shaped charge carrier assembly apparatus for use in a perforating gun comprising:

at least one shaped charge including an outer case, said case having a generally cylindrical outer surface having first and second oppositely facing annular shoulders defined thereon;

a carrier having a substantially circular charge opening disposed therethrough large enough to receive said generally cylindrical outer surface of said case with said first annular shoulder abutting said carrier, said carrier also having at least one tool receiving aperture disposed therethrough; and deformable retaining means, permanently attached to said carrier adjacent a periphery of said charge opening, for engaging said second annular shoulder upon deformation of said deformable retaining means to thereby retain said shaped charge in said charge opening, said deformable retaining means disposed adjacent said tool receiving aperture so that each of said deformable retaining means is at least partially defined between one of said tool receiving apertures and said charge opening.

18. The apparatus of claim 17, wherein:

said deformable retaining means is integrally ed with said carrier.

19. The apparatus of claim 18, wherein:

said carrier is a thin wall carrier.

20. The apparatus of claim 17, wherein:

said carrier is a tubular thin wall carrier having a substantially circular cross section.

21. The apparatus of claim 20, wherein:

said carrier is further characterized in that said substantially circular charge opening has a reduced diameter portion located approximately in and adjacent a plane normal to a longitudinal central axis of said tubular carrier, so that said first annular shoulder abuts said carrier at at least two substantially diametrically opposed points of support on a periphery of said reduced diameter portion of said charge opening; and said deformable retaining means is further characterized in that there are at least two separate deformable retaining means on opposite sides of an imaginary line between said at least two substantially diametrically opposed points of support.

22. The apparatus of claim 21, wherein:

said carrier, said charge opening, and said shaped charge are so dimensioned and arranged that, when said first annular shoulder abuts said at least two points of support on the periphery of said reduced diameter portion of said charge opening said second annular shoulder is located radially inward of said at least two separate deformable retaining means, so that upon subsequent deformation of said at least two separate deformable retaining means longitudinally into said charge opening and radially inward against said second annular shoulder, said shaped charge is held between said at least two points of support and said at least two separate deformable retaining means.

23. The apparatus of claim 22, wherein:

said shaped charge is further characterized in that said first and second annular shoulders thereof are located intermediately along a length of said case.

24. The apparatus of claim 22, wherein:

said shaped charge is further characterized in that said second annular shoulder thereof is located substantially adjacent an end of said case.

25. The apparatus of claim 21, wherein:

said carrier is further characterized in that said reduced diameter portion of said charge opening is formed by two diametrically opposed arcuate edge portions along said periphery of said charge opening so that said first annular shoulder abuts each circumferential end of each of said arcuate edge portions and thus abuts at least four points of support.

26. The apparatus of claim 21, wherein:

said shaped charge is so held between said at least two points of support and said at least two separate deformable retaining means that said shaped charge is oriented with its central longitudinal axis extending substantially radially relative to said tubular carrier.

27. A shaped charge carrier assembly apparatus for use in a perforating gun, comprising:

at least one shaped charge including an outer case, said case having a generally cylindrical outer surface having first and second oppositely facing annular shoulders defined thereon;

a tubular thin wall carrier having a substantially circular cross-section and having a substantially circular charge opening disposed therethrough large enough to receive said generally cylindrical outer surface of said case with said first annular shoulder abutting said carrier, said substantially circular charge opening having a reduced diameter portion located approximately in and adjacent a plane normal to a longitudinal central axis of said tubular carrier, so that said first annular shoulder abuts said carrier at at least two substantially diametrically opposed points of support on a periphery of said reduced diameter portion of said charge opening, said thin wall carrier also including a tool receiving aperture disposed therethrough; and deformable retaining means, permanently attached to said carrier adjacent a periphery of said charge opening, for engaging said second annular shoulder upon deformation of said deformable retaining means to thereby retain said shaped charge in said charge opening, said deformable retaining means having at least two separate deformable retaining means on opposite sides of an imaginary line between said at least two substantially diametrically opposed points of support, said deformable retaining means disposed adjacent said tool receiving aperture so that each of said deformable retaining means is at least partially defined between one of said tool receiving apertures and said charge opening.

28. The apparatus of claim 27, wherein:

each of said tool receiving apertures is completely separate from said charge opening.

29. The apparatus of claim 27, wherein:

each of said deformable retaining means includes a relatively flexible beam portion having two ends both of which are integrally fixed to said thin wall carrier, each of said beam portions being defined between one of said tool receiving apertures and said charge opening.

30. The apparatus of claim 29, wherein:

each of said deformable retaining means further includes a tab portion integrally attached to said beam portion between the two ends thereof, said tab portion extending from said beam portion toward said charge opening.

31. The apparatus of claim 30, wherein:

each of said tool receiving apertures is an elongated slot oriented substantially parallel to a length of said beam portion of one of said deformable retaining means.

32. The apparatus of claim 31, wherein:

said beam portion of each of said deformable retaining means is further characterized as being torsionally flexible, so that upon insertion of a thin bladed tool into said tool receiving aperture and rotation of said tool about an axis parallel to said length of said beam portion with an inserted end of said tool moving toward said charge opening, said beam portion is bowed toward said charge opening so that said tab portion extends into said charge opening, and said beam portion is torsionally rotated in a direction opposite to that in which said tool was rotated, thus moving said tab portion away from a plane of said thin wall carrier in the same direction as which said tool was inserted into said tool receiving aperture.

33. The apparatus of claim 31, wherein:

said beam portion of each of said deformable retaining means is further characterized as being sufficiently flexible that upon insertion of a thin bladed tool into said tool receiving aperture and rotation of said tool about an axis parallel to said length of said beam portion with an inserted end of said tool moving away from said charge opening said beam portion is bowed toward said charge opening so that said tab portion extends into said charge opening, and said beam portion is further bowed away from a plane of said thin wall carrier in the same direction as which said tool was inserted into said tool receiving aperture.

34. The apparatus of claim 29, wherein:

said relatively flexible beam portion of each of said deformable retaining means is further characterized as being deformable into said charge opening upon application of a sufficient force to a mid portion thereof, said force being directed from said tool receiving aperture toward said charge opening.

35. The apparatus of claim 34, wherein:

each of said tool receiving apertures is an elongated slot oriented substantially tangential to a closest point of said periphery of said charge opening.

36. The apparatus of claim 35, wherein:

said thin wall carrier further includes a second tool receiving opening disposed therethrough and spaced from each of said elongated slots on a side thereof opposite said charge opening, so that a pair of pliers or the like can be engaged with said second tool receiving opening and said beam portion of said deformable retaining means to deform said beam portion away from said charge opening.

37. The apparatus of claim 17, wherein:

said deformable retaining means includes a relatively flexible beam portion having at least one end thereof integrally fixed to said carrier, said beam portion being deformable into said charge opening upon application of a sufficient force thereto.

38. The apparatus of claim 17, wherein:

said second annular shoulder defines a face of a reduced diameter groove formed in said generally cylindrical outer surface of said outer case of said shaped charge.

39. The apparatus of claim 1 wherein said inner charge holder means includes a holder tube disposed concentrically within said charge carrier assembly and having at least one frustoconical radially oriented opening of a size such that said second inwardly tapered surface of said shaped charge outer case is received therein.

40. The apparatus of claim 39 wherein said carrier assembly further includes a second tool receiving aperture, adjacent said tool receiving aperture, on a side opposite said charge opening such that a pair of pliers, or the like can be engaged with said second tool receiving aperture and said deformable retaining means can be deformed in a direction away from said charge opening, thereby disengaging said shaped charge form said tubular thin wall carrier.

41. A shaped charge comprising a case having generally cylindrical outer surface joined by a tapered annular enlarged diameter outer surface substantially adjacent an end of said shaped charge, to thereby define an enlarged diameter flange means adjacent said end of said shaped charge.

42. The shaped charge of claim 41, wherein:

said flange means is further defined by a second tapered annular enlarged diameter outer surface oppositely and extending completely to said end of said shaped charge.

* * * * *

UNITED STATES PATENT AND TRADEMARK OFFICE

CERTIFICATE OF CORRECTION

PATENT NO. : 4,800,815

DATED : January 31, 1989

INVENTOR(S) : Roger C. Appledorn, Lary G. Ratliff, William C. Behling, and Michael L. Oestreich It is certified that error appears in the above-identified patent and that said Letters Patent is hereby corrected as shown below:

In column 7, line 20 delete [12] and insert therefore --152--.
In column 11, line 12 delete [ed] and insert therefore --formed--.
In column 14, line 29 delete [form] and insert therefore --from--.
In column 14, line 40 following oppositely insert therefore --tapered from said first mentioned tapered annular surface,--.

Signed and Sealed this

Eighteenth Day of July, 1989

*Attest:*

*Attesting Officer*

DONALD J. QUIGG

*Commissioner of Patents and Trademarks*